United States Patent [19]

Houck

[11] 4,004,470

[45] Jan. 25, 1977

[54] DRILLING APPARATUS FOR DRILLING SMALL DIAMETER BORE HOLES DEEP INTO THE EARTH

[75] Inventor: Theodore B. Houck, Tulsa, Okla.

[73] Assignee: Parker Drilling Company, Inc., Tulsa, Okla.

[22] Filed: Sept. 15, 1975

[21] Appl. No.: 613,773

Related U.S. Application Data

[60] Continuation of Ser. No. 445,131, Feb. 25, 1975, abandoned, which is a continuation-in-part of Ser. No. 344,090, April 23, 1973, Pat. No. 3,933,059, which is a division of Ser. No. 194,182, Nov. 1, 1971, Pat. No. 3,767,329.

[52] U.S. Cl. ..... 74/661

[51] Int. Cl.[2] ..... F16H 37/06

[58] Field of Search ..... 74/661, 665 B, 665 D, 74/665 P, 665 L

[56] References Cited

UNITED STATES PATENTS 1,990,810 2/1935 Young ..... 74/665 L X 3,157,065 11/1964 Isenberg et al. ..... 74/665 L X

*Primary Examiner*—Samuel Scott
*Assistant Examiner*—Frank H. McKenzie, Jr.
*Attorney, Agent, or Firm*—Head, Johnson & Chafin

[57] ABSTRACT

This abstract describes the power compound portion of a bore hole drilling system, which is designed for drilling medium depths of wells, and is designed for portability so that each part of the system can be broken down into subassembly units which are of less than a selected total weight. Thus, the entire system can be transported by helicopters capable of carrying said selected weight. The power compound comprises a self-contained engine manifold to which can be coupled two engines through corresponding gear transmissions to two input shafts. The transmission system in the manifold comprises drive means for driving a pump from each engine through a clutch, at a selected lower speed. It also comprises drive means for coupling the two engine shafts to provide combined power outputs to a shaft which drives the draw works.

2 Claims, 3 Drawing Figures

DRILLING APPARATUS FOR DRILLING SMALL DIAMETER BORE HOLES DEEP INTO THE EARTH

CROSS REFERENCE TO RELATED PATENT

This is a continuation of application Ser. No. 445,131, filed Feb. 25, 1975, now abandoned which is a continuation-in-part of Ser. No. 344,090, filed April 23, 1973, now U.S. Pat. No. 3,933,059 which is a divisional application of Ser. No. 194,182, filed November 1, 1971, by the same inventor as this application, and assigned to the same assignee. Application 194,182 is now issued as Patent No. 3,767,329 and is made part of this application by reference.

BACKGROUND OF THE INVENTION

This invention is in the field of deep bore hole drilling machines. More particularly, it is concerned with the drilling of oil wells to depths of the order of 5,000 to 15,000 feet in depth. It is concerned moreover with a design of drilling apparatus which is demountable into many small subassemblies, each of which has a total weight of less than a selected maximum weight, so that it can be carried by helicopter.

While it has been common in the area of small drilling machines, such as used for geophysical operations, to build them in separate small subassemblies, so that they could be transported easily by backpack or by pack mule into remote areas, it has never been practical heretofore to design a drilling rig which is required to drill to great depths, in the form of a demountable system, with limitations on each part of the system to be under the selected weight.

SUMMARY OF THE INVENTION

In studying the overall design of such a drilling system it became clear that the most difficult part of the drilling system to design on a demountable basis was the power compound and the draw works. These necessarily involve many parts and heavy pieces of equipment such as engines, pumps, etc. This application deals only with the engine, power compound and pump system.

By designing the system so that the speed range could be taken care of at high engine speeds, that is by the use of a high-speed gear transmission, it now becomes practical to reduce the number of drive shafts and chains in the power train.

This system is designed for two engines, each with its own high speed gear transmission, and two pumps to be driven through separately controlled clutches, with the option of coupling the two engines together to drive the draw works. Each engine is coupled through a high speed gear transmission to one input of the power compound. The power compound includes two input shafts and two output pump shafts, each carrying a clutch, with a chain drive between input and output shafts. Chain drive is provided between the two input shafts, through a jaw clutch, so that one or both engines can be coupled to a shaft which drives the draw works.

It is a primary object of this invention to provide a simple easily demountable power system for a drilling rig which when assembled can be used for drilling deep bore holes to the depth of the order of 5,000 to 15,000 feet, and which can be demountable into small subassemblies, each of which weigh less than a selected magnitude.

BRIEF DESCRIPTION OF THE DRAWINGS

These and other objects and a better understanding of the principles and details of this invention, will be evident from the following description, taken in conjunction with the appended drawings in which.

Figure 1:
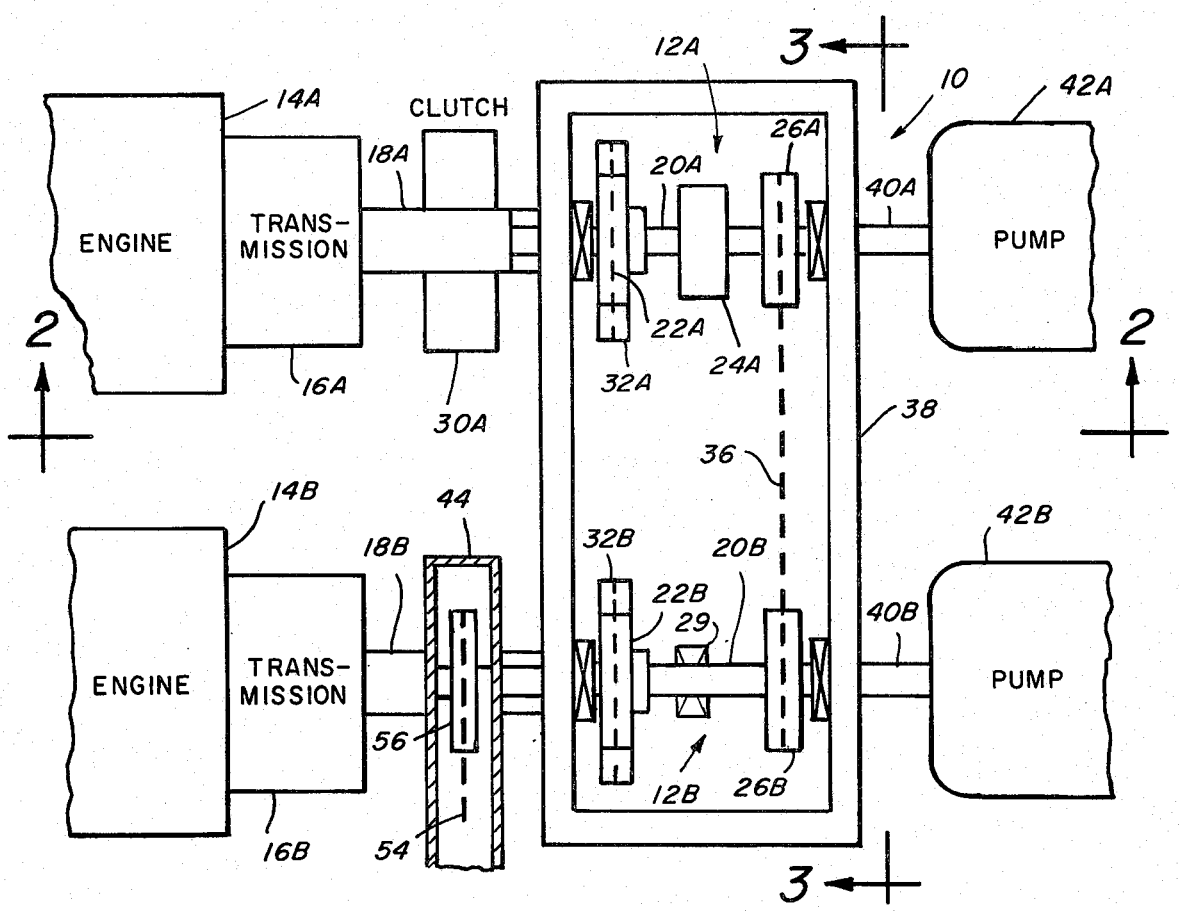
FIG. 1 indicates a plan view of the engines, transmissions, power compound and pumps.
Figure 2:
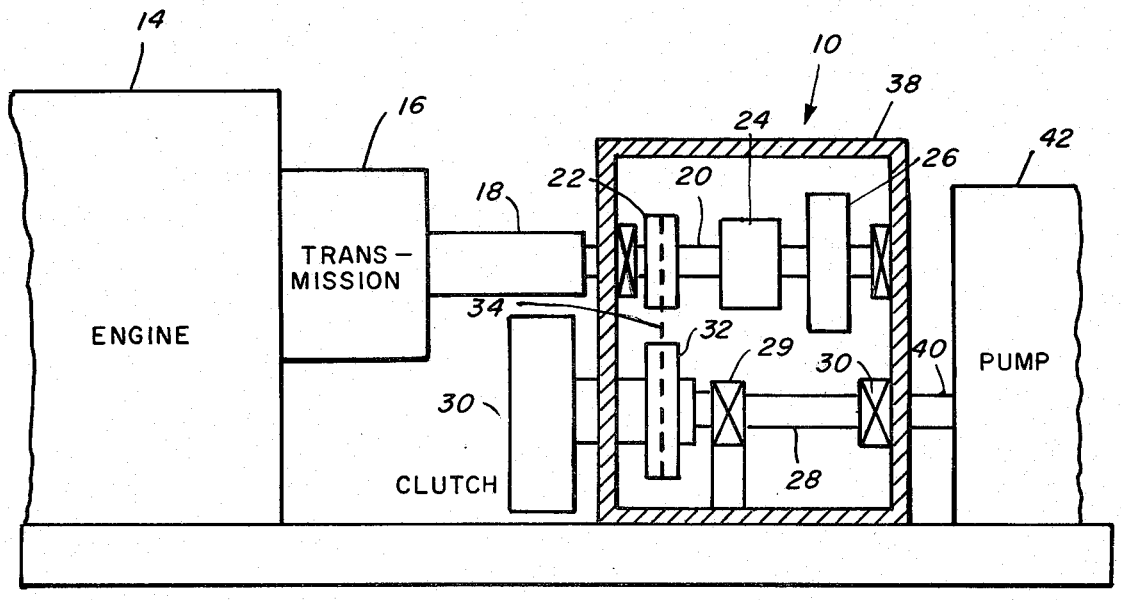
FIG. 2 indicates a vertical view along the plane 2—2 of FIG. 1.

Referring now to the drawings and in particular to FIG. 1 there is shown a plan view of the power compound indicated generally by the numeral 10, the two engines 14A, 14B, two gear transmissions 16A, 16B direct coupled to the engines, and the drives 18A, 18B to the two input shafts of the power compound. The power compound comprises a rectangular structural housing 38 having two transmissions 12A, 12B. These comprise input shafts 20A and 20B adapted to be lined up axially with the gear transmissions 16A, 16B, and coupled thereto conventional shaft coupling means, not shown, but well understood in the art. Each of the two shafts 20A, 20B, has a first sprocket 22A, 22B and a second sprocket 26A, 26B. The sprockets 26A, and 26B are joined by a chain 36, by means of which the two engines can be coupled together to drive the draw works, which is driven by chain 54 carried by sprocket 56, on the engine shaft of the second engine 14B.

The shaft carrying the sprocket 56 is direct coupled to the engine 14B through transmission 16B so that the draw works is always driven by the engine 14B. Simultaneously, the pump 42B can be driven through shaft 40B which is coupled to output shaft 28 which carries the clutch 30B, driven by sprocket 22B through chain 34B to a sprocket 32B mounted on the clutch housing. Thus, each engine directly drives one mud pump by means of the chains 34A, 34B, the pumps being controlled by the clutches 30A and 30B, respectively.

In addition, the drive shaft 20A includes a jaw clutch 24A by means of which the engine 14A can be disconnected from the drive chain 36 whereby the draw works chain 54 is driven only by the second engine 14B. Conversely, when the jaw clutch 24A is engaged, both engines 14A and 14B are connected by means of the chain 36 to drive the output sprocket 56 and the chain 54 to the draw works as shown in FIG. 3.

The simplicity of this engine, pump and power manifold is easily visualized, since to break up the system for transportation, the four couplings between the gear transmissions and the power manifold, and between the pumps and the power manifold, are disconnected, leaving five pieces of equipment each of which is under the maximum weight can be transported separately. They can also be rapidly reconnected for use as the power unit for the draw works and the rotary table.

Figure 3:
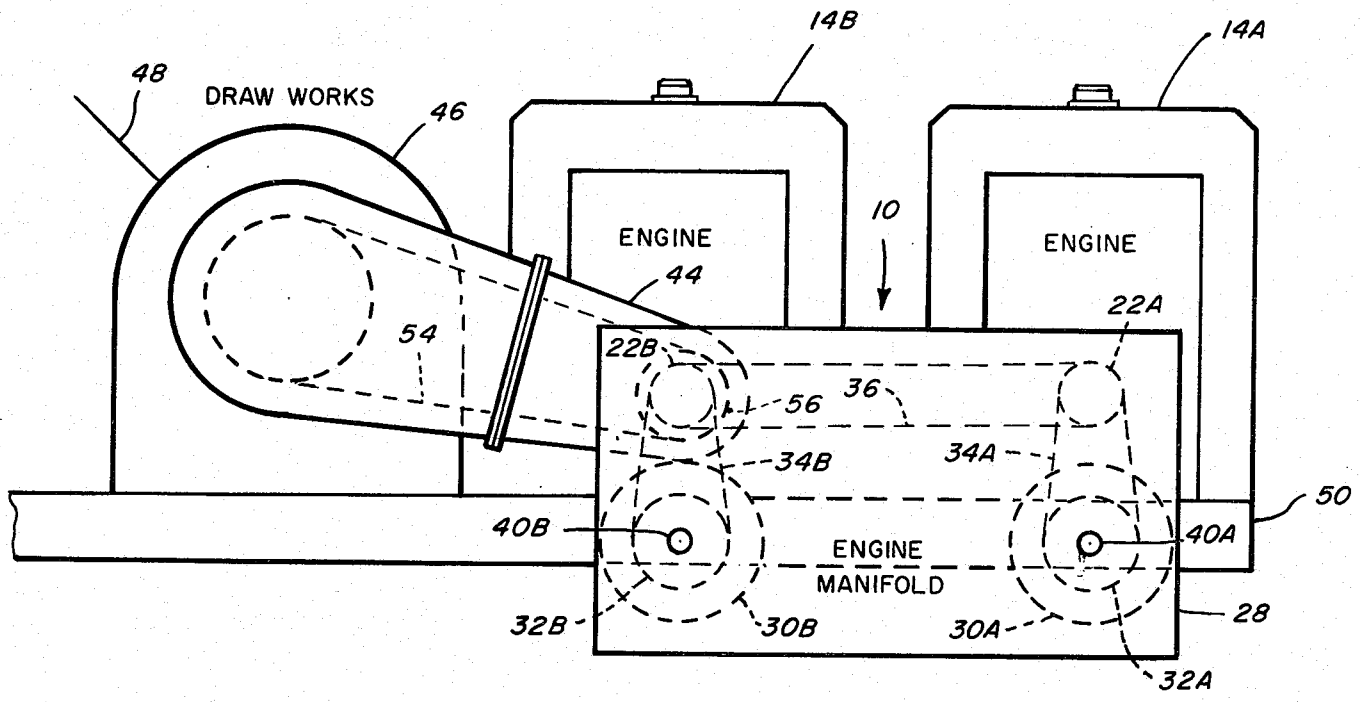
FIG. 3 indicates a view of the entire assembly including the drive to the draw works taken along the plane 3—3 of FIG. 1.

FIG. 3 illustrates in an elevation view, the relative position of the two engines, the power manifold and the draw works, including the cable 48. Since the view is taken along the plane 3—3 of FIG. 1 the pumps are not shown, but the pump shafts 40A and 40B are shown.

While the invention has been described with a certain degree of particularity it is manifest that many changes may be made in the details of construction and the arrangement of components. It is understood that the invention is not to be limited to the specific embodiment set forth herein by way of exemplifying the invention but the invention is to be limited only by the scope of the attached claim or claims, including the full range of equivalency to which each element or step thereof is entitled.

What is claimed:

1. Apparatus for powering a drilling rig comprising:

a draw works;

a first engine having a transmission with a first engine drive shaft;

a second engine having a transmission with a second engine drive shaft;

a draw works drive sprocket on said second engine drive shaft and means to rotatably connect said draw works drive sprocket to said draw works;

a first input shaft detachably connected to said first engine drive shaft;

a second input shaft detachably connected to said second engine drive shaft;

a pump drive sprocket and a shaft coupling sprocket in tandem on said first input shaft;

a coupling clutch in said first input shaft between said first pump drive sprocket and said shaft coupling sprocket, the clutch having an engaged position and a disengaging position;

a pump drive sprocket and a shaft coupling sprocket in tandem on said second input shaft;

a first pump having a pump drive shaft and a sprocket thereon;

a second pump having a pump drive shaft and a sprocket thereon;

a chain coupling said pump drive sprocket on said first input shaft with said first pump shaft sprocket;

a chain coupling said pump drive sprocket on said second input shaft with said second pump shaft sprocket; and a chain connecting said shaft coupling sprockets of said first and second input shafts;

said input shafts, said pump and coupling sprockets thereon, said coupling clutch, said pump drive shafts and sprockets thereon, and said chains being housed together in a power unit for transportation separate from said engines, pumps and draw works and whereby said draw works may be powered by said second engine alone when said coupling clutch is disengaged or by said first and second engines together when said coupling clutch is engaged.

2. Apparatus for powering a drilling rig according to claim 1 including:

a first pump clutch selectably connecting or disconnecting said first pump shaft sprocket with said first pump shaft; and a second pump clutch selectably connecting or disconnecting said second pump shaft sprocket with said second pump shaft.

* * * * *